United States Patent [19]

Grenell

[11] Patent Number: 4,524,470

[45] Date of Patent: Jun. 25, 1985

[54] TOILET LID LOCK MECHANISM

[76] Inventor: David J. Grenell, 1396 Hadden Cir., Akron, Ohio 44313

[21] Appl. No.: 659,010

[22] Filed: Oct. 9, 1984

[51] Int. Cl.[3] ..... A47K 13/24

[52] U.S. Cl. ..... 4/253; 16/333; 16/343; 292/228

[58] Field of Search ..... 4/251, 253; 292/219, 292/228; 16/333, 343

[56] References Cited

U.S. PATENT DOCUMENTS

| | | | |
|---|---|---|---|
| 350,851 | 10/1886 | Taylor | 16/343 |
| 2,651,053 | 9/1953 | Rowe et al. | 4/253 |
| 2,698,439 | 1/1955 | Bruckner | 4/253 |
| 2,996,731 | 8/1961 | Leptrone | 4/253 |

*Primary Examiner*—Charles E. Phillips
*Attorney, Agent, or Firm*—Mack D. Cook, II

[57] ABSTRACT

A lock mechanism normally restraining manual raising movement of a toilet lid. A lid control shoe has an outer portion adapted for attachment to a lid upper surface and a shelf portion projecting toward a toilet apron surface. A lid control arm is mounted on a medially positioned shelf pivot and has a short portion extending toward the shoe outer portion and a long portion extending toward an area adjacent the apron surface. Tension elements and a stop element carried by the shoe shelf normally position the control arm long portion and a vertical flange thereon in proximity to the apron surface. Preferably, the lid control arm projects upwardly toward the toilet apron surface at an angle of substantially five degrees (5°).

2 Claims, 4 Drawing Figures

TOILET LID LOCK MECHANISM

BACKGROUND OF THE INVENTION

The present invention deals with one of the many problems parents face and must try to solve while rearing children. To small children, the bathroom toilet may offer mystery and adventure. Unsupervised raising of a toilet lid by small children, often followed by the throwing in of small objects, not only is an unpleasant thought but can lead to costly plumbing stoppage or damage.

The present invention relates to an article of manufacture intended for use as a lock mechanism for a toilet lid. The invention provides the parents of small children with emotional assurance that the toilet lid will automatically remain down, locked closed, until an older or adult person decides that the time has come to raise the lid.

At present, the inventor has no knowledge of any prior art patents which could, alone or in combination, defeat novelty of the invention.

SUMMARY OF THE INVENTION

It is an object of the invention to provide an improved lock mechanism for use in combination with a hinged toilet lid and an apron surface on a vertical extension of the toilet.

It is a further object of the invention to provide a toilet lid lock mechanism which may be kept clean and sanitary, which is unobtrusive and neat in appearance, and which will automatically maintain the toilet lid down, locked closed, until an older or adult person decides that the lid should be raised.

These and other objects of the invention will become apparent in view of the drawings and the detailed description.

A lock mechanism according to the invention for normally restraining a manual raising movement of a toilet lid has a lid control shoe with an outer portion having an under surface for selective attachment to the upper surface of the toilet lid. The control shoe also has a shelf portion projecting toward the toilet apron surface above the lid upper surface. The under side of the control shoe shelf has a medially positioned pivot. The lock mechanism also has a lid control arm rotatably mounted at the control shoe shelf pivot. The lid control arm has a short portion extending toward the control shoe outer portion and a long portion extending toward an area adjacent the toilet apron surface. The lid control arm long portion has an inwardly directed side at the end thereof and carries a vertical flange extending substantially parallel to the toilet apron surface. The lock shoe shelf carries a tension means and a stop means to normally position the lid control arm vertical flange in proximity to the toilet apron surface and to allow movement of said flange away from said apron when said arm is manually pivoted.

THE DRAWINGS

DETAILED DESCRIPTION OF THE INVENTION

Figure 1:
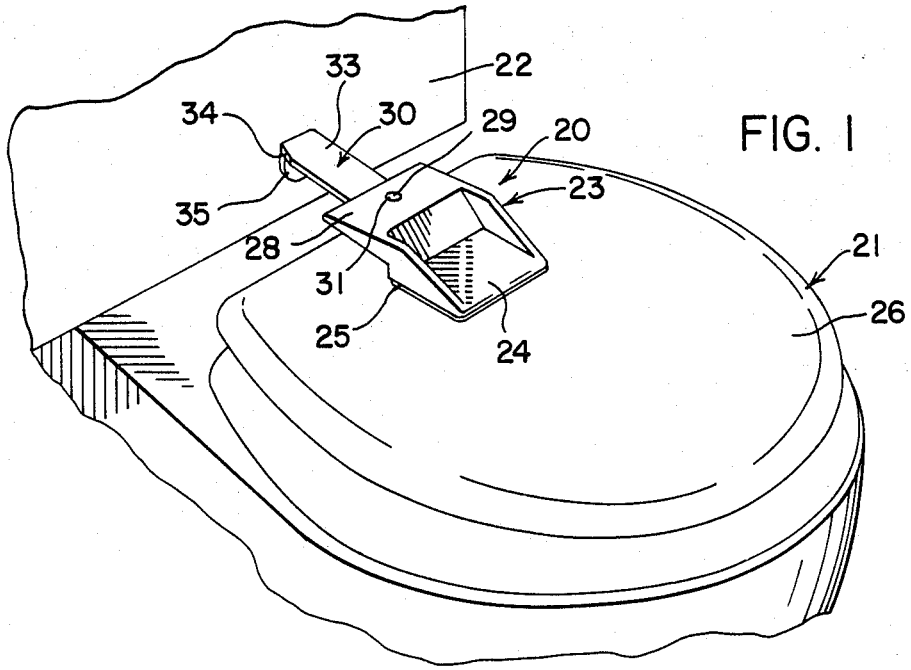
FIG. 1 is a perspective view of a lock mechanism according to the invention in position for use.
Figure 2:
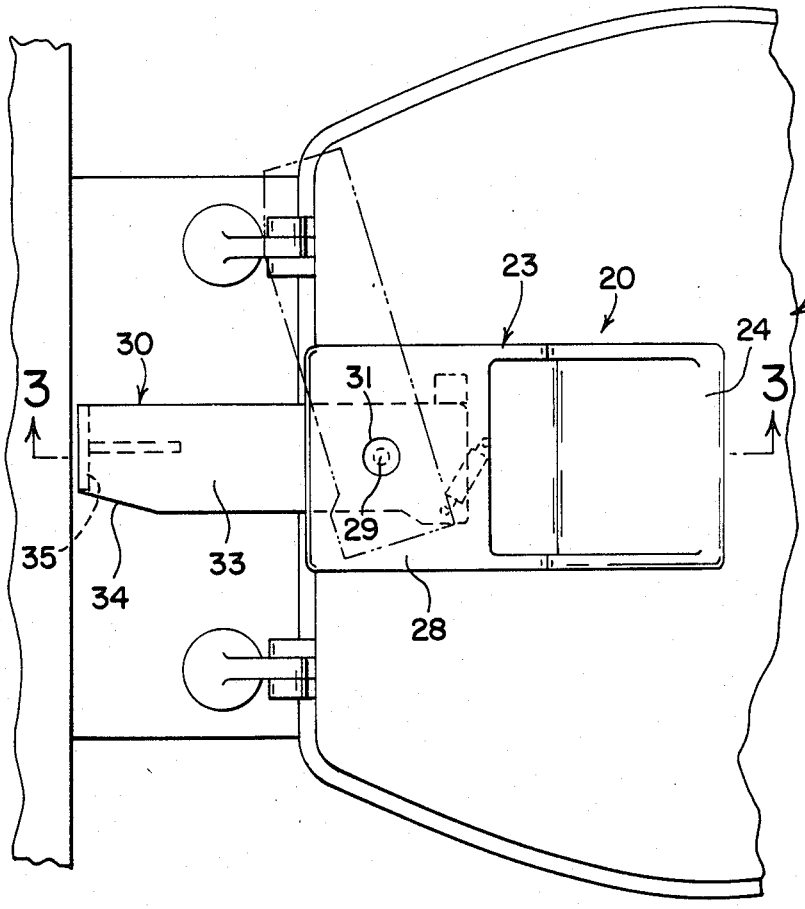
FIG. 2 is a fragmentary top plan view.

A lock mechanism according to the invention is referred to generally by the numeral 20. The lock mechanism 20 is used in combination with a hinged toilet lid, indicated at 21, and an apron surface, indicated at 22, on a vertical extension of the toilet.

A lock mechanism 20 has a lid control shoe referred to generally by the numeral 23. The lock shoe 23 has an outer portion 24 with an under surface 25. The lock shoe under surface 25 is attached to the upper surface 26 of the toilet lid 21, as by a suitable layer of pressure-sensitive adhesive or cement 27. The lock shoe 23 further has a shelf portion 28 projecting toward the toilet apron surface 22 above the lid upper surface 26. The under side of the shelf 28 has a medially positioned pivot point 29.

A lock mechanism 20 further has a lid control arm 30 movably mounted at the shelf pivot point 29, as by an inverted cap bolt 31. The lid control arm 30 has a relatively short portion 32 extending toward the shoe outer portion 24 and a relatively long portion 33 extending toward an area or point adjacent the toilet apron surface 22. The control arm long portion 33 has an inwardly directed side 34 at the end thereof, to provide clearance from the toilet apron surface 22 during manual rotation of the lid control arm 30 so that the toilet lid 21 may be raised. The control arm long portion 33 terminates at a vertical flange 35 extending substantially parallel to the toilet apron surface 22 so that without manual rotation of the lid control arm 30 the lid 21 may not be raised.

The shoe shelf portion 28 carries a tension means indicated at 36, and a stop means, indicated at 37, reactive on the control arm short portion 32 to normally position the control arm vertical flange 35 in proximity to the toilet apron surface 22.

Figure 3:
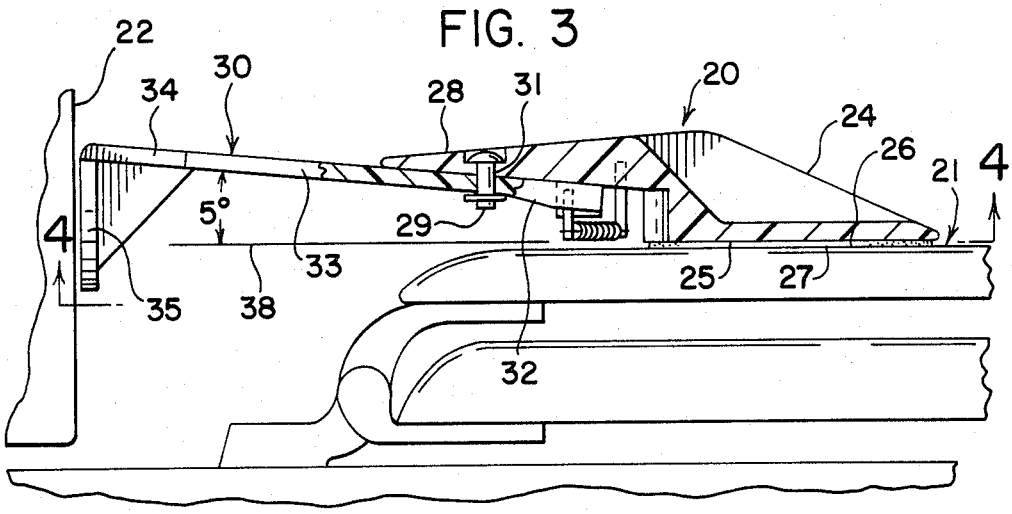
FIG. 3 is a side view, taken substantially as indicated on line 3—3 of FIG. 2.
Figure 4:
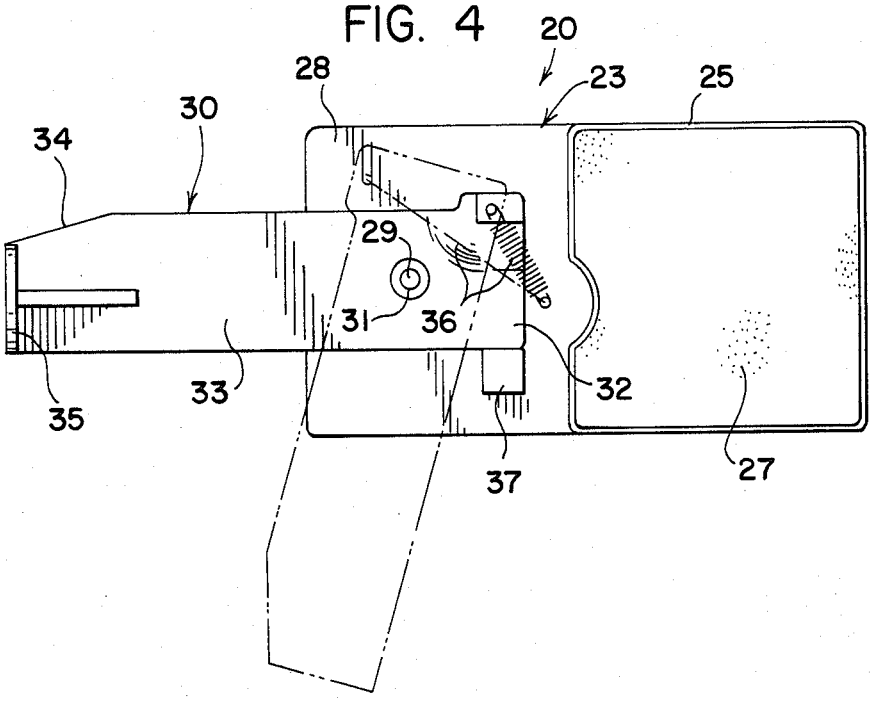
FIG. 4 is a bottom view, taken substantially as indicated on line 4—4 of FIG. 3.

As shown in FIG. 3, the lid control arm 30 projects upwardly toward the toilet apron surface 22 at an angle of substantially five degrees (5°) in relation to the orientation plane of the lid control shoe under surface 25; as indicated by a reference line 38. If the control arm 30 and the plane of the control shoe under surface 25 are substantially the same, with less than the five degree divergence, the surface of vertical flange 35 would function as a hinge or pivot point against the toilet apron surface 22 so that there would be minimal or no locking action. If the divergence is substantially greater than five degrees, the resultant increase in the moment arm provided by the control arm long portion 33 may overstress or break the bond provided by the adhesive or cement 27 securing the control shoe 23 to the toilet lid 21, if an attempt is made to raise the lid 21 in the locked condition.

What is claimed is:

1. For use, in combination with a hinged toilet lid and an apron surface disposed substantially perpendicular with respect to the plane of said lid a lock mechanism normally restraining a manual raising movement of said toilet lid about a lid hinge;

said lock mechanism having a lid control shoe with an outer portion having an under surface adapted for attachment to an upper surface on said lid and a shelf portion projecting toward said toilet apron surface above said lid upper surface, the under side of said shoe shelf having a medially positioned pivot;

said lock mechanism further having a lid control arm movably rotatably mounted at said shoe shelf pivot, said arm having, when in a locking position, a short portion on one side of said pivot extending toward said shoe outer portion and a long portion on the other side of said pivot extending toward an area adjacent said toilet apron surface, said control arm long portion having an inwardly directed side at the end thereof, away from said pivot, said control arm long portion carrying a vertical flange extending substantially parallel to said apron surface;

said lock shoe shelf carrying a tension means and a stop means to normally position said control arm vertical flange in proximity to said toilet apron surface and to allow movement of said flange away from said apron when said arm is manually pivoted.

2. A toilet lid lock mechanism according to claim 1, wherein said lid control arm will project upwardly toward a toilet apron surface at an angle of substantially five degrees in relation to the plane of said lid control shoe under surface.

* * * * *